US005722235A

United States Patent [19]

Cumins

[11] Patent Number: 5,722,235

[45] Date of Patent: Mar. 3, 1998

[54] EXHAUST GAS BACK PRESSURE ATTENUATOR FOR TRUCK EXHAUST STACKS

[75] Inventor: Bailey L. Cumins, Tulsa, Okla.

[73] Assignee: CCL, Inc., Tulsa, Okla.

[21] Appl. No.: 702,896

[22] Filed: Aug. 26, 1996

[51] Int. Cl.[6] ..... F02B 35/00

[52] U.S. Cl. ..... 60/274; 60/316; 60/324; 454/1; 454/2; 454/39

[58] Field of Search ..... 60/316, 324, 274; 454/1, 2, 39

[56] References Cited

U.S. PATENT DOCUMENTS

| | | | |
|---|---|---|---|
| 20,909 | 7/1858 | Webster | 454/39 |
| 156,426 | 11/1874 | Lanston . | |
| 411,323 | 9/1889 | Carper | 454/2 |
| 744,950 | 11/1903 | Withers . | |
| 1,635,938 | 7/1927 | Hudson . | |
| 2,161,895 | 6/1939 | Brenner . | |
| 2,396,952 | 3/1946 | Huber . | |
| 2,500,510 | 3/1950 | Barnes . | |
| 2,887,033 | 5/1959 | Wachter | 454/2 |
| 2,984,967 | 5/1961 | Caddell . | |
| 3,016,692 | 1/1962 | Iapella et al. . | |
| 3,045,421 | 7/1962 | Pagliuca . | |
| 3,788,072 | 1/1974 | Burger . | |
| 4,106,290 | 8/1978 | Johnson . | |
| 4,198,817 | 4/1980 | Fujita et al. . | |
| 4,205,706 | 6/1980 | Jasensky . | |
| 4,335,575 | 6/1982 | Pagliuca . | |
| 4,665,691 | 5/1987 | Eller . | |
| 4,671,171 | 6/1987 | Brill . | |
| 4,903,484 | 2/1990 | Yates et al. . | |
| 4,970,859 | 11/1990 | Yates et al. . | |
| 5,174,113 | 12/1992 | Deville . | |

*Primary Examiner*—Douglas Hart
*Attorney, Agent, or Firm*—William S. Dorman

[57] ABSTRACT

The present invention relates generally to an exhaust gas back pressure attenuator for truck exhaust stacks. In particular, the present invention is directed toward an improved exhaust gas deflector that reduces the back pressure within the vertical tubular exhaust stacks of over-the-road type tractor-trailer trucks. At highway speeds a number of factors may operate to make it difficult for the engine to force exhaust gas out of the system and into the atmosphere. The present invention is attached to the top of the stack and is designed to create an aerodynamic low-pressure condition that in effect pulls the exhaust gas from the stack, thereby reducing back pressure buildup, decreasing the load on the engine, and increasing the fuel efficiency. A first embodiment of the present invention employs an air wedge to divide a first ambient air volume and cause it to pass on either side of the exhaust stack, thereby creating a pressure differential which operates to pull the exhaust gases thereout. This embodiment also provides a second stage exhaust enhancement, wherein a second volume of air flows up an upper ramp plate, accelerating it, and creating a second pressure differential, thereby pulling the first volume of air and mixed exhaust gases from the lower portion of the device. A second embodiment, for use on curved exhaust stacks, combines a forward air scoop that empties air directly into the stack with the secondary exhaust enhancement discussed previously.

14 Claims, 6 Drawing Sheets

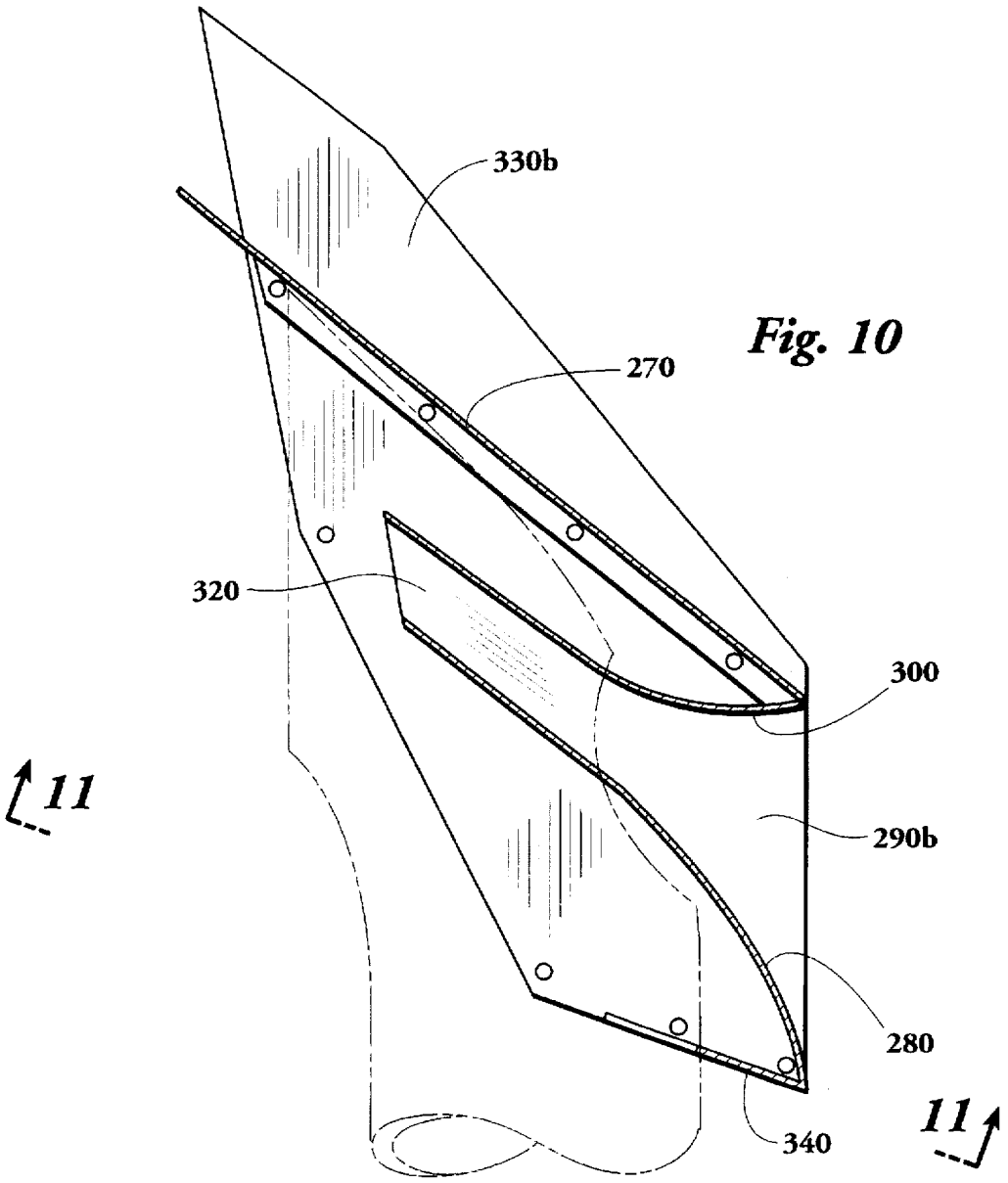
Fig. 10
Fig. 11
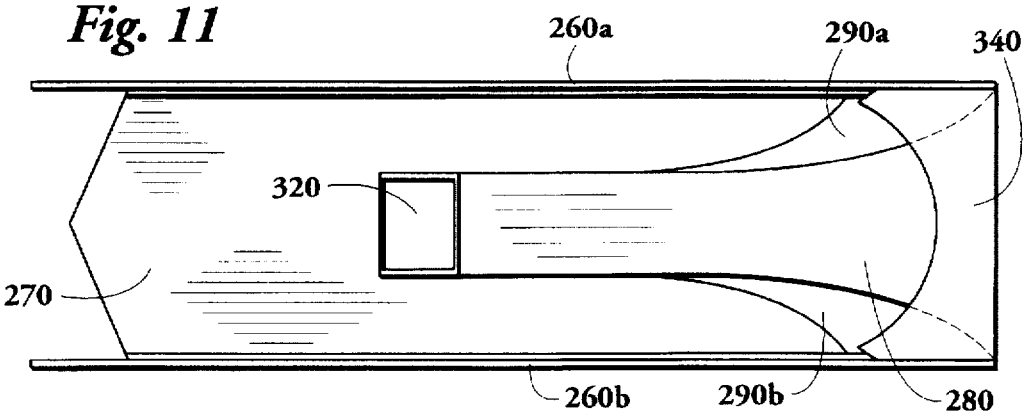

EXHAUST GAS BACK PRESSURE ATTENUATOR FOR TRUCK EXHAUST STACKS

I. BACKGROUND OF THE INVENTION

A. Field of the Invention

The present invention relates generally to an exhaust gas back pressure attenuator for truck exhaust stacks. In particular, the present invention is directed toward an improved exhaust gas deflector that reduces the back pressure that rises within vertical tubular exhaust stacks of over-the-road type tractor-trailer trucks. These tubular truck exhaust pipes carry enormous quantities of engine exhaust gas away from the engine and release these by-products of combustion at or near the top of the cab. However, at highway speeds a number of factors may operate to make it difficult for the engine to force exhaust gas out of the system and into the atmosphere. The present invention is designed to be attached to the top of the exhaust stack or tube and is aerodynamically designed to create a low-pressure condition that in effect pulls the exhaust gas from the stack. This reduction in the buildup of exhaust gas back pressure decreases the load on the engine and ultimately results in increased fuel efficiency.

B. Description of the Prior Art

Gases that are created as a by-product of internal combustion must be moved away from the engine and are typically discharged into the atmosphere. In the case of large diesel trucks, the preferred method of discharging the exhaust gas is through large vertical exhaust pipes or stacks. These exhaust stacks are a prominent feature on most tractor-trailer trucks, being large chromed pipes three to six inches in diameter that extend vertically to a height of as much as thirteen feet. The stack typically rises to a height slightly greater than that of the truck, which may or may not be higher than the trailer that is towed behind. This just reflects the reality of modern highway transportation, wherein the maximum height of the truck must be carefully monitored because its height may restrict its ability to pass beneath some overpasses and bridges. Further, a special permit is required to operate trucks taller than thirteen feet six inches on interstate highways.

One obvious consequence of having the terminus of the exhaust stack near the top of the trailer is that soot that is carried with the exhaust gas is deposited thereupon. The net results is that the trailer or cargo may become blackened and unsightly and must, therefore, be cleaned or cleared more often. Thus, other things being equal, most drivers would prefer taller exhaust stacks.

A less obvious consequence of the typical truck exhaust system arrangement is that, at highway speeds, a number of factors can operate to make the expulsion of exhaust gases difficult, resulting in the creation of exhaust back pressure. In particular, the use of turbochargers and mufflers can restrict the free flow of exhaust gases out of the system. Longer exhaust pipes and pipes with one or more rams therein tend to inhibit the flow of exhaust. Undersized stack pipes, while completely adequate at low speeds, may prove to be of insufficient diameter on the highway when the quantity of exhaust gas expelled is much greater. Finally, the movement of the ambient air across and around the stack opening produces aerodynamic turbulence which inhibits the free flow of exhaust gases out of the stack.

The foregoing are just some of the many factors that can contribute to the formation of exhaust gas pressure buildup within the stack. This pressure buildup is of more than just academic interest because its effects are reflected in terms of decreased engine power and increased fuel consumption. When the pressure increases, the engine must labor harder to expel its own combustion byproducts, diverting horsepower that otherwise might be applied to moving the vehicle and its load. Further, positive back-pressure can cause exhaust gases to be forced back into the combustion chamber during the intake cycle, thereby increasing the amount of soot accumulating in the cylinders and reducing the cylinder volume available for the incoming fuel-air mixture. Thus, the ultimate effect of exhaust gas back pressure is to lower the efficiency of the engine and decrease the distance that a gallon of fuel would otherwise move the engine. These effects becomes more pronounced at higher velocities, causing the truck engine to work increasingly harder at higher speeds to overcome this pressure buildup.

Heretofore, as is well known in the over the road trucking industry, there has been a need for a device that would assist the passage of exhaust gas out of the pipes, thereby reducing the pressure buildup within. In particular, the unit should operate passively, since the power to operate it would otherwise ultimately have to be drawn from the engine, thereby reducing the horsepower available to propel the vehicle. The unit should create a suction effect that assists the engine by pulling exhaust gases from the stack and become more powerful at higher vehicle velocities. It should also with assist the expulsion of exhaust gases by redirecting the flow of ambient air so as to reduce or eliminate the turbulence that causes the back pressure buildup. It would preferably expel the exhaust gases such that they do not tend to impinge upon the trailer and deposit soot thereon. Finally, the device should protect the open stack exhaust outlet from rain and snow, either of which could have detrimental effects if allowed into the stack.

Accordingly, it should now be recognized, as was recognized by the present inventor, that there exists, and has existed for some time, a very real need for an exhaust gas back pressure attenuator for truck exhaust stacks that would address and solve the above-described problems.

Briefly, one embodiment of the exhaust gas back pressure attenuator described herein acts passively to redirect the flow of ambient air around the truck exhaust stack in such a manner as to create a partial vacuum external to the exhaust outlet. The present embodiment sits atop a straight truck exhaust stack and consists of a leading ramp plate which directs a first volume of ambient air up and into the device where it is split apart by a V-shaped divider into two subsidiary streams. The subsidiary streams are directed around the stack terminus and thereby accelerated, creating a low pressure aerodynamic condition. The exhaust from the stack is pulled into this partial vacuum and is then expelled through an exhaust outlet provided at the rear of the device, thereby reducing the possibility of back pressure buildup. This feature is referred to as the primary or first stage exhaust enhancement.

In addition to the first stage exhaust enhancement, a second stage exhaust enhancement feature is also provided. In particular, as the truck moves down the highway, the upper surface of the device, being in the form of an inclined ramp, catches and moves a second volume of air upward along its face. At the terminus of the upper surface, said terminus being located proximate to the exhaust outlet at the rear of the device, a second low pressure area is created. This second low pressure differential operates to assist in pulling the first volume of air and mixed exhaust gases from within the device out into the atmosphere. Said second stage exhaust enhancement also tends to direct the exhaust gas upward and away from the tractor and trailer, thereby reducing deposits thereon. The effectiveness of this dual stage exhaust enhancement in reducing back pressure can be readily measured. The instant inventor has discovered that use of the present embodiment on a loaded standard tractor-trailer combination can produce gains in fuel efficiency of 20% or more at highway speeds.

A second embodiment of the present invention is designed for use with curved exhaust stacks. The curved exhaust stack must first be modified by cutting an opening into the elbow of the stack on the side facing the front of the truck. The present embodiment is a device consisting of a forward facing air scoop which catches a first volume of ambient air. Said first air volume travels through the air scoop and then passes into and through a progressively narrowing throat. As this first volume of ambient air moves deeper into the throat of the device, the constriction tends to accelerate it. Said device is installed such that the throat member passes through said opening in the stack and extends some distance within. At the terminus of the throat, said terminus being well inside of the stack, the accelerated first volume of ambient air is released into the exhaust stack in a direction that is generally parallel with the natural direction of travel of the exhaust gases. The additional thrust provided by said accelerated air urges the exhaust gases out of the stack more rapidly than they would be expelled otherwise. This is the primary or first stage exhaust enhancement feature for this embodiment.

In addition to the primary exhaust enhancement effect, a second stage exhaust enhancement feature, as discussed previously, is also provided. In particular, the upper surface of the present embodiment is also formed as an inclined plane, said plane catching and moving a second volume of air upward along its face. At the terminus of the upper surface, said terminus being located proximate to the exhaust stack outlet, a second low pressure area is created. This second low pressure differential operates to assist in pulling the first volume of air and mixed exhaust gases from within the stack. Said second stage exhaust enhancement also tends to direct the exhaust gas upward and away from the tractor and trailer, thereby reducing deposits thereon. The inventor has discovered that the use of the present embodiment on a loaded standard tractor-trailer combination can produce gains in fuel efficiency up to 20% or more at highway speeds. Finally, the length of the throat, and thus the distance that is extended into the stack, has some bearing on the fuel efficiency so obtained, the optimal length being determined by trial and error for a particular type of truck stack exhaust.

After the present invention was conceived and constructed, a patent search was conducted in the United States Patent and Trademark Office for the purpose of determining whether any similar or related solutions had been previously developed to the foregoing problems. That patent search produced the following references relating to exhaust enhancing devices:

| U.S. Pat. No. | Inventor | Title | Issue Date |
|---|---|---|---|
| 156,426 | Lanston | Locomotive Smoke-Stacks | Nov. 3, 1874 |
| 744,950 | Withers | Ventilator for Ships | Nov. 24, 1903 |
| 1,635,938 | Hudson | Cooling Mechanism for Internal Combustion Engines | Jul. 12, 1927 |
| 2,161,895 | Brenner | Exhaust Scavenger | June 13, 1939 |

-continued

| U.S. Pat. No. | Inventor | Title | Issue Date |
|---|---|---|---|
| 2,396,952 | Huber | Muffler | Mar. 19, 1946 |
| 2,500,510 | Barnes | Exhaust Pressure Reducing Attachment for Engine Exhaust Pipes | Mar. 14, 1950 |
| 2,984,967 | Caddell | Exhaust Temperature Air-Cooling System | May 23, 1961 |
| 3,016,692 | Iapella et al. | Combustion Engine Exhaust Treatment | Jan. 16, 1962 |
| 3,045,421 | Pagliuca | Exhaust Back Pressure Reducer For Internal Combustion Engines | Jul. 24, 1962 |
| 3,788,072 | Burger | Rain Cap for Exhaust Pipe | Jan. 29, 1974 |
| 4,106,290 | Johnson | Protective Cap Assembly for an Exhaust Pipe | Aug. 15, 1978 |
| 4,198,817 | Fujita et al. | Exhaust Gas Diffuser | Apr. 22, 1980 |
| 4,205,706 | Jasensky | Protective Cap for an Exhaust Pipe | Jun. 3, 1980 |
| 4,335,575 | Pagliuca | Exhaust Back Pressure Reducer for Internal Combustion Engine | Jun. 22, 1982 |
| 4,665,691 | Eller | Exhaust Back Pressure Reducer | May 19, 1987 |
| 4,671,171 | Brill | Aerodynamically Operated Rain Cap | Jun. 9, 1987 |
| 4,903,484 | Yates et al. | Exhaust Dissipator and Deflector | Feb. 27, 1990 |
| 4,970,859 | Yates et al. | Exhaust Gas Deflector for Truck Exhaust Stacks | Nov. 20, 1990 |
| 5,174,113 | Deville | Exhaust Outlet With Venturi | Dec. 29, 1992 |

U.S. Pat. Nos. 3,788,072 to Burger, 4,106,290 to Johnson, 4,205,706 to Jasensky, and 4,671,171 Brill all disclose an apparatus for protecting an exhaust stack from encroachment by rain, ice, and snow. None of these devices addresses the problem of exhaust gas back-pressure buildup and, in fact, some of these devices would tend to aggravate the problem.

Several of the patents listed above disclose devices that are designed to be attached to an automobile tail pipe. Automobile engines are also susceptible to exhaust gas back pressure buildup, but the aerodynamics are different because the ambient air stream is parallel to the exhaust pipe and the pipe itself is horizontal. For example, Pagliuca U.S. Pat. Nos. 3,045,421 and 4,335,575 both involve venturi restrictions that compress ambient air streams in the direction of the exhaust pipe, rather than moving the ambient air streams around the exhaust pipe as one aspect of the invention herein disclosed teaches. Barnes U.S. Pat. No. 2,500,510 also exploits the geometry of the typical automobile exhaust arrangement, but again does not split the ambient air stream around the exhaust pipe, nor does he provide a second stage vacuum assist as is disclosed herein.

Fujita et al. U.S. Pat. No. 4,198,817 discloses a device that provides for improved exhaust gas temperature reduction prior to discharge and also provides improved mixing of the exhaust gases with the ambient air stream. It is not directed toward exhaust gas back pressure reduction nor would it operate to do so, as it is directed toward creating turbulence within the device to better mix exhaust gas and ambient air.

Brenner U.S. Pat. No. 2,161,895 discloses a forward facing air scoop for use on an automobile exhaust pipe. Unlike the present inventors, Brenner does not split the air stream around the exhaust pipe nor does he provide a secondary vacuum assist. In the same vein, Iapella et al. U.S. Pat. No. 3,016,692 teaches a forward facing air scoop that contains helical vanes which create a vortex, and associated reduced pressure area, behind the terminus of the exhaust pipe, thereby drawing the exhaust gas out the pipe. The is a completely different approach than that utilized by the instant inventor. Huber U.S. Pat. No. 2,396,952 discloses an automobile muffler and also uses a forward facing air scoop. U.S. Pat. Nos. 2,396,952 to Huber and 3,016,692 Iapella et al. differ from the instant invention for the same reasons as Brenner U.S. Pat. No. 2,161,895 discussed previously.

Deville U.S. Pat. No. 5,174,113 discloses a muffler which tends to increase the exhaust gas back pressure, but less so than other mufflers.

U.S. Pat. Nos. 2,984,967 to Caddell and 1,635,938 to Hudson disclose cooling systems for internal combustion engines. Caddell proposes modifying a conventional exhaust system to improve it. The invention disclosed herein is designed to work with conventional exhaust systems. Hudson's invention is directed toward eliminating excess heat in an air cooled engine. Both U.S. Pat. Nos. 2,984,967 to Caddell and 1,635,938 to Hudson have a different object than that disclosed herein.

Withers U.S. Pat. No. 744,950 discloses a ventilator for ships, said ventilator being designed to utilize ambient air streams to withdraw air from below decks. Withers does not split the ambient air stream into two substreams nor does he provide a second stage vacuum assist as disclosed herein. Further, he does not teach the advantage of adding air fences or fins to the sides of the device.

Lanston U.S. Pat. No. 156,426 discloses an improved locomotive smoke stack which is designed to increase combustion in the engine furnace by increasing the exhaust draft. This smoke stack utilizes a forward facing scoop that feeds an ambient air stream directly into the engine exhaust pipe, thereby accelerating the expulsion of exhaust gas. Lanston differs from the first embodiment discussed above in that he does not split the ambient air stream into two substreams nor does he provide a second stage vacuum assist as disclosed herein. Lanston may be distinguished from the second embodiment discussed above in that he does not teach the advantage of having a throat member extend into the interior of the exhaust pipe nor does he teach the value of a secondary vacuum assist.

Eller U.S. Pat. No. 4,665,691 discloses a back pressure reducing device that is designed to be used with an air deflector of the sort that is sometimes seen mounted over the cab of the truck. Biter does not split the ambient air stream into two substreams nor does he provide a second stage vacuum assist as disclosed herein.

Yates et al. U.S. Pat. Nos. 4,903,484 and 4,970,859 both disclose improved exhaust gas deflectors for use on truck exhaust stacks. Neither patent teaches splitting the ambient air stream into two substreams. Both patents illustrate ambient air being scooped up and blown directly across the open top of the truck stack, a condition that is expressly avoided in the present invention, as it would tend to increase the amount of turbulence in the stack, thereby tending to increase the exhaust back pressure.

Thus, the above-listed patents are clearly distinguishable from the present invention, a description of which is set forth below. Before proceeding to that description, however, it should be noted and remembered that the description of the invention which follows, together with the accompanying drawings, should not be construed as limiting the invention to the examples (or preferred embodiments) shown and described. This is so because those skilled in the art to which the invention pertains will be able to devise other forms of this invention within the ambit of the appended claims.

II. SUMMARY OF THE INVENTION

The instant invention provides an exhaust gas back-pressure attenuator that operates in a passive manner and utilizes ambient air streams created by the forward motion of the truck to aerodynamically assist the expulsion of exhaust gases from a truck stack. This device is designed to be attached to the top of a truck exhaust stack and operates generally to create an aerodynamic partial vacuum condition near the opening of the stack, thereby drawing exhaust gases from the stack and decreasing back pressure buildup therein. It also acts to reduce the air turbulence that arises around the stack terminus while the truck is in motion. Among the objects of the present invention are to decrease the truck exhaust back pressure and thereby increase the fuel efficiency of the truck engine, reduce exhaust emissions, improve engine performance, reduce the deposition of soot on the trailer and tractor, and protect the stack against encroachment by snow and rain. A further object is to provide conditions within the engine that favor a more complete combustion cycle, thereby reducing the formation of sulfur acids and decreasing acid contamination of the oil in the crankcase. Still a further objective is the reduction of the effects of thermal shock during periods of instantaneous peak load demand through more efficient removal of hot exhaust gases from the cylinders. Finally, it is an overall objective of the present invention to lessen the impact of large tractor-trailer trucks on the environment by increasing their fuel efficiency and reducing the quantity of incompletely oxidized hydrocarbons and other waste products that are expelled into the atmosphere.

According to one aspect of the present invention there has been provided an apparatus for reducing truck exhaust back pressure which has been designed for use with trucks having straight stacks. This embodiment is formed of a forward base plate which is mounted facing the front of the truck, the leading edge of which is tilted down somewhat relative to horizontal, an intermediate base plate which is horizontally mounted, and a rear base plate, the trailing edge of which is tilted upward very steeply relative to the horizontal. The forward base plate acts as an air scoop and gathers a first volume of ambient air into the device as the truck is driven along the roadway. A forward pointing V-shaped air divider sitting atop the forward base plate splits this first volume into two components, thereby accelerating its velocity and creating a low pressure condition therein. Immediately behind said V-shaped air divider is the terminus of the truck exhaust stack, which extends upward into the device through a hole formed within the forward and intermediate base plates. The terminus of the stack is held within a clamping collar and is shielded from air entering the device on its forward facing side by an upward extension of said collar. The now-divided ambient air is smoothly directed on either side of the collar and its enclosed truck exhaust, thereby creating a low pressure region behind the collar. The collar has two broad functions in the present embodiment: first, its upper extent shields the forward portion of the truck stack terminus and works together with the air divider to direct the ambient air around the stack and, second, its lower extent contains fastening means by which to attach the instant invention to the stack. It is only the first function that is important to the inventon disclosed herein and those skilled in he art will recognize that the instant invention could be attached to a truck stack by any number of methods, including, by way of example only, the clamping means which is disclosed as part of a preferred embodiment. The stack terminus is positioned within the device so as to empty exhaust gases into said low pressure region created by the air divider/collar combination, said low pressure assisting the expulsion of the stack contents. The now expelled exhaust gas is combined with the substreams of ambient air and carded further within the device, to be ultimately discharged behind it. An inclined top plate, which forms a roof of the device, engages a second volume of ambient air and utilizes it to create a trailing low pressure region at its rearward edge, said region tending to pull the first volume of ambient air and exhaust gas mixture from within the device. Said top plate also tends to directs the combined air exhaust gas and ambient air mix up and away from the front face of the towed trailer. The creation of the trailing low pressure region is enhanced by the inclusion of two or more fins or fences, one mounted on either side of the top plate, that constrain the ambient air flow to remain atop the device.

According to a second aspect of the present invention, there is provided an apparatus for reducing truck exhaust back pressure which has been designed for use with trucks having curved or slanted stacks. This embodiment contains a forward facing air scoop into which a first volume ambient air is directed. As said opening extends into the device, it is narrowed to form a throat, thereby accelerating the flow of air therethrough. This embodiment is mounted on a curved stack by cutting a hole into the elbow of the stack on the side facing the front of the truck. The narrowed throat of the present embodiment is then inserted into the hole such that the ambient air collected by the air scoop is forced at accelerated speeds into the stack. This rush of ambient air urges the exhaust gas out of the stack, thereby reducing the buildup of back pressure. The expulsion of gas from the stack is further assisted by the presence of an inclined top plate which engages a second volume of ambient air, the rear edge of said top plate extending slightly beyond the stack terminus. Said top plate creates a low pressure region behind it, said low pressure region tending to pull the mixture of ambient air and exhaust gas from the stack and direct it up and away from the following trailer. The top plate may also be provided with one or more fins or air fences to further constrain the air flow and thereby aid and enhance the formation of the low pressure region.

In the previous discussion, the language has been couched in terms of the typical exhaust configurations of a common 18-wheel tractor-trailer combination. But, it is understood by those skilled in the art that the invention herein described could be applied to other vehicles, exhaust arrangements, and configurations as well.

III. BRIEF DESCRIPTION OF THE DRAWINGS

Figures 7A, 7B:
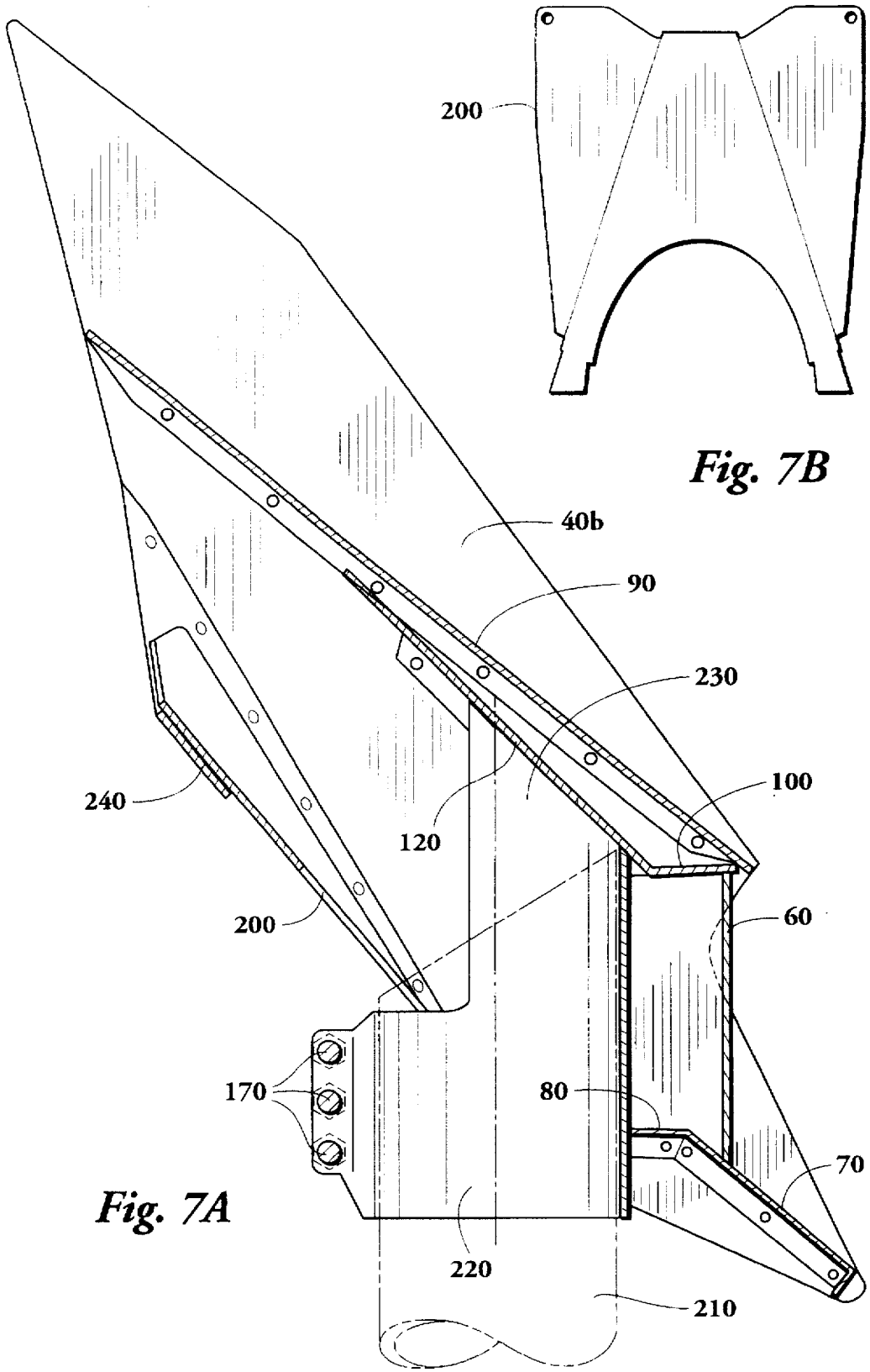

FIG. 7*a* is a cut-away view of the essential elements of another presently preferred embodiment of the instant invention, wherein the device has been adapted to work with a stack terminus that is cut on a slant. This figure also illustrates the structure of the clamping collar and associated modified air shield.

FIG. 7*b* is a plan view of the seal plate 200 element.

Figure 8:
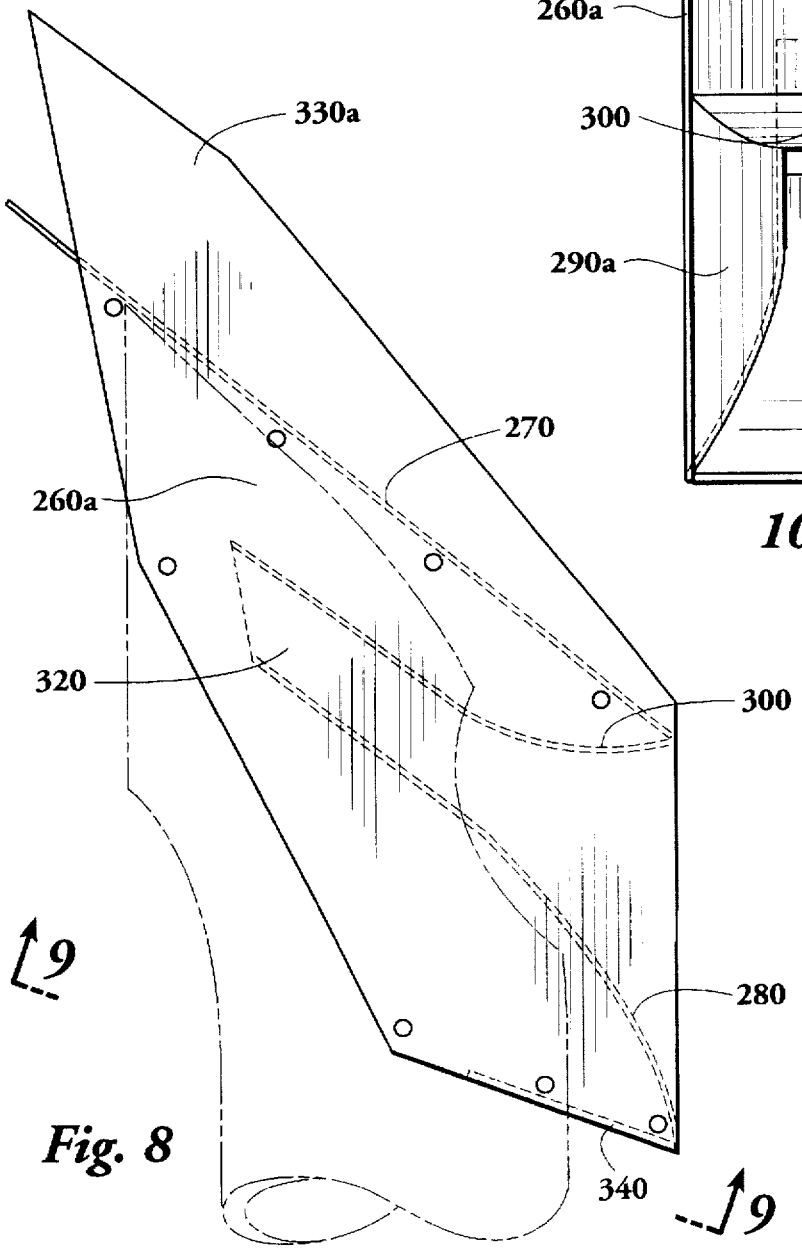

FIG. 8 is an elevational side view of the essential elements of another presently preferred embodiment of the instant invention wherein the device has been adapted to work with a stack terminus that is curved and which is equipped with upper side rails.

Figure 9:
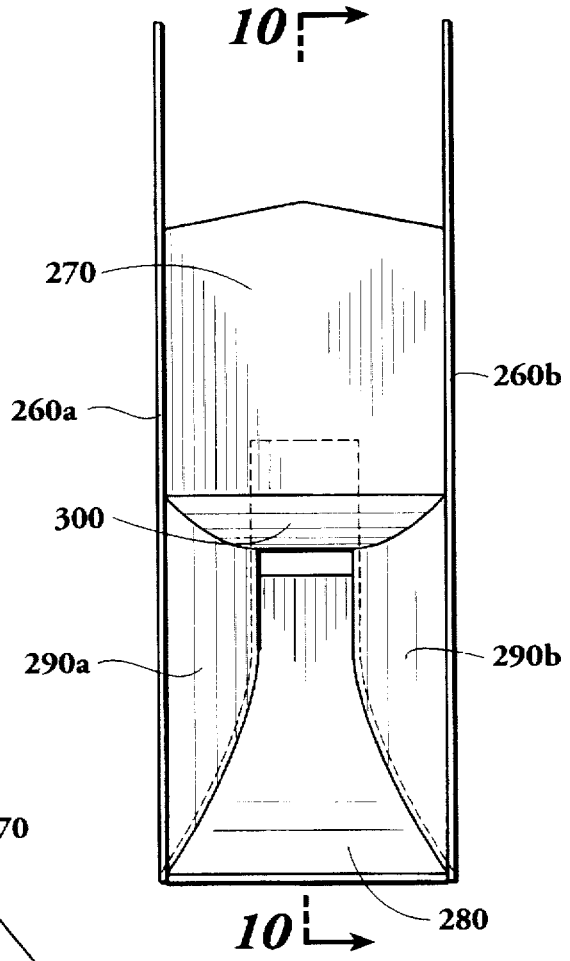

FIG. 9 is a front view of the device pictured in FIG. 8.

FIG. 10 is a cross sectional view taken along the line 9—9 of FIG. 9.

FIG. 11 is a bottom view of the embodiment of FIG. 8, said view taken along the line 11—11 of FIG. 10.

IV. DETAILED DESCRIPTION OF THE PREFERRED EMBODIMENTS

Figure 1:
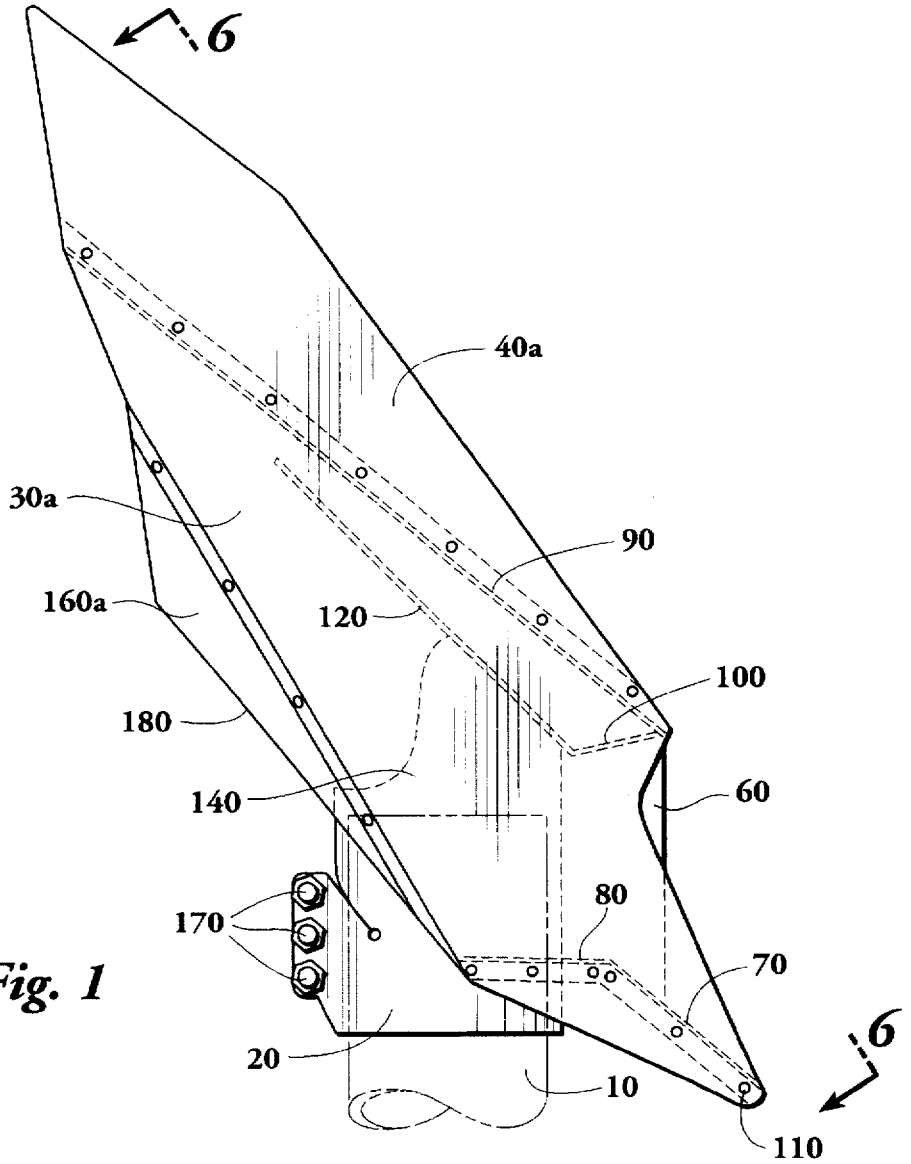
FIG. 1 is an elevational side view of the essential elements of a presently preferred embodiment of the instant invention wherein the device is shown attached to the terminus of a straight exhaust stack with a horizontally cut stack tube and the device is equipped with upper side rails.
Figure 2:
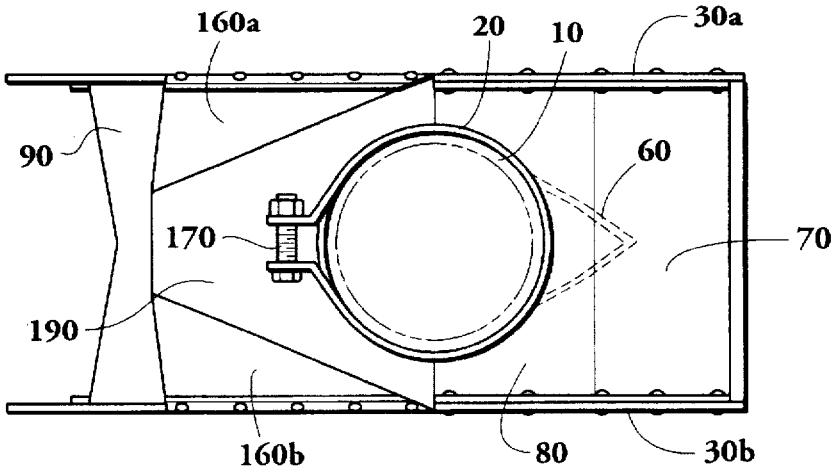
FIG. 2 is a bottom view of the instant invention, wherein a clamping means is illustrated.

Referring to the drawings in detail, wherein like numerals denote identical elements throughout the several views, there is shown in FIG. 1 a schematic representation of a preferred embodiment of the present invention which is adapted for use with a straight exhaust stack having a terminus which is horizontal. In FIG. 1 there is provided a device for reducing the exhaust gas back pressure in a tractor-trailer truck stack in which a clamping collar 20 containing nut and bolt combination 170 accepts a vertical truck exhaust stack 10 and fastens the present invention thereto. An air intake orifice at the front of said device is jointly defined by a forward heat shield plate 100, forward base plate 70, V-shaped air divider 60, top plate 90, and sidewalls 30*a* and 30*b*, the leading edge of said forward base plate 70 being tipped downward relative to the horizontal to increase the volume of air engaged. When the vehicle is in motion, said air intake orifice guides a first ambient air stream into the device wherein said first air stream is split by air divider 60 into two streams and are thereby accelerated. Said accelerated air streams pass over intermediate base plate 80 and around the upper portion of clamping collar 20, said clamping collar upper portion forming a truck stack air shield 140, creating a partial vacuum condition behind said air shield 140. Exhaust from stack 10 is expelled upward against rear heat shield plate 120 and is subsequently drawn into and combined with said accelerated air streams. The combined ambient air and exhaust gas streams are urged upward and toward the rear of the present invention, across rear base plate 190 which is bounded by left 160*a* and right 160*b* streamlining plates, said streamlining plates being designed to reduce the amount of air turbulence generated at the rear of the device. As the exhaust gases exit the device at its rear, they are further urged outward by the design and configuration of top plate 90 and side walls 30*a* and 30*b*. The inclination of top plate 90 accelerates a second ambient air stream upward along it, thereby creating a partial vacuum condition at the rear of top plate 90. Side walls 30*a* and 30*b* are extended above top plate 90 so as to form fins which constrain said second ambient air stream to travel along the length of the device, thereby increasing the vacuum effect behind it, reducing the amount of turbulence generated at the trailing edge of the top plate, and increasing the overall effectiveness of the device.

Figure 3:
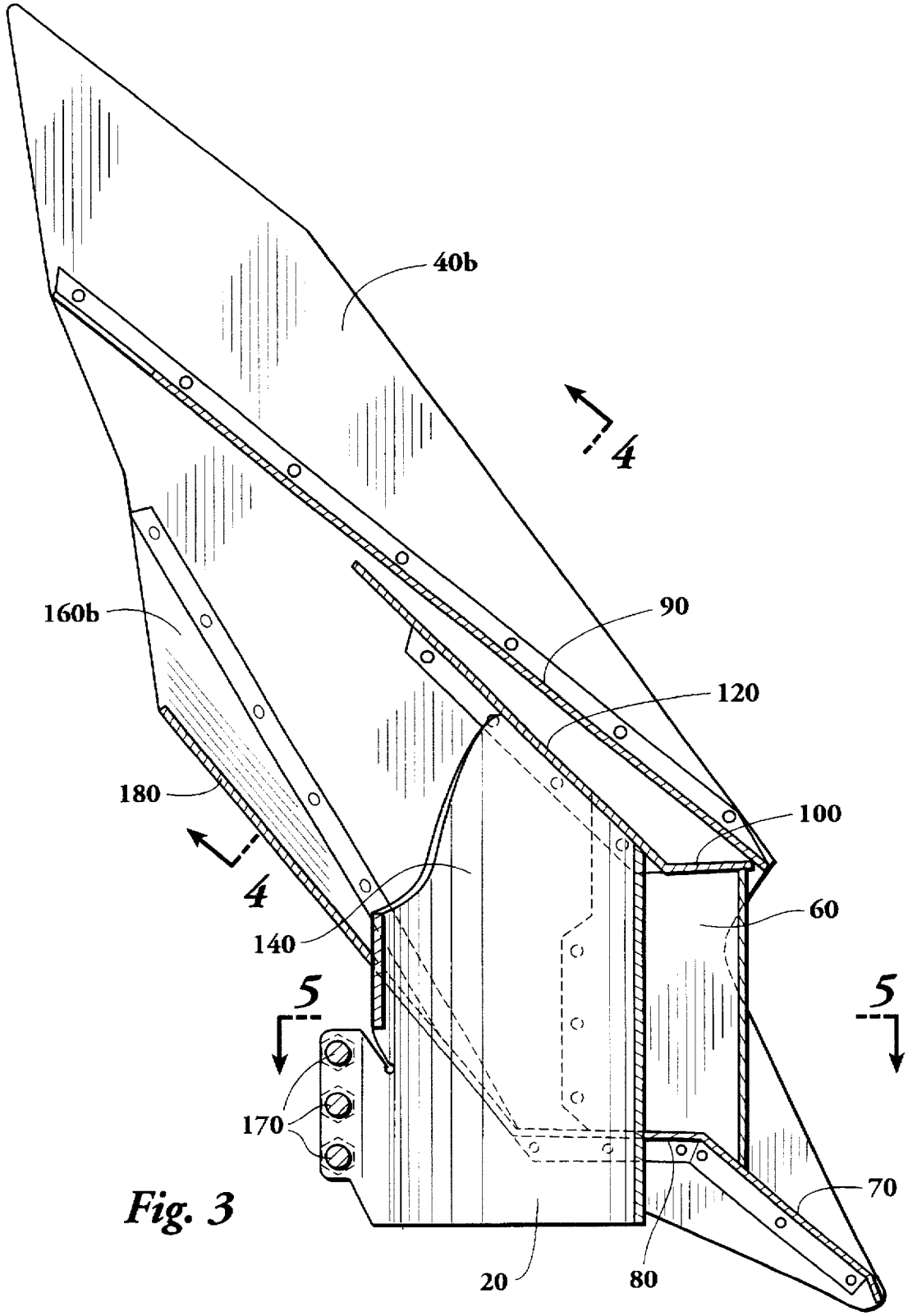
FIG. 3 is a cut away side view which illustrates how the clamping means terminates inside of the device.
Figure 4:
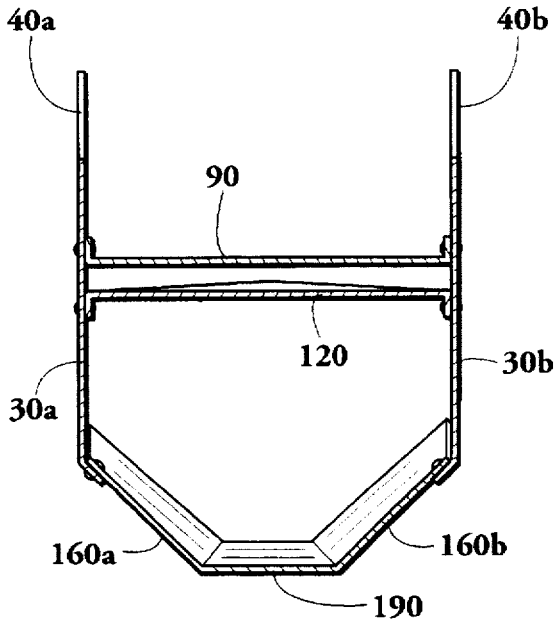
FIG. 4 is a cross sectional view taken along the line of 4—4 in FIG. 3.
Figure 5:
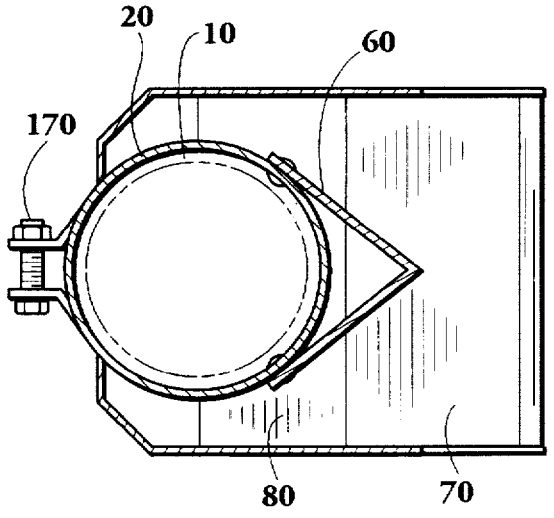
FIG. 5 is a cross sectional view taken along the line of 5—5 in FIG. 3.
Figure 6:
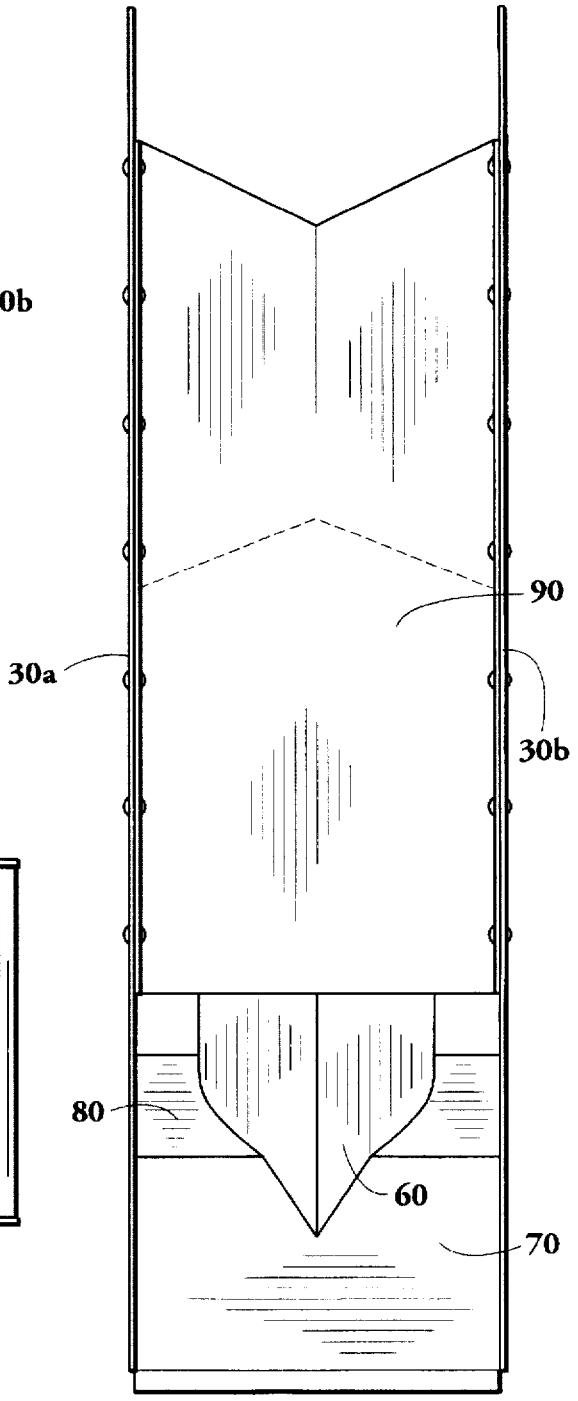
FIG. 6 is a top view of the instant invention taken along the line 6—6 of FIG. 1.

FIG. 3 is a cross sectional view of the same embodiment, in which the clamping collar 20 is more fully illustrated. In particular, the rearward portion of the upper extent of the clamping collar 20, previously denominated as air shield 140, may be seen to have been cut away, thereby creating a means for the exhaust gases to enter the interior of the present embodiment and be thereafter mixed with the divided first ambient air streams. FIG. 4 is a cross sectional view of the present embodiment which illustrates the internal structure of the air passageway wherein the first ambient stream and exhaust gases are mixed and carried to the rear of the device. FIG. 5 is a downward-looking cross section that clearly illustrates how the first ambient air stream is separated by V-shaped divider 60 into two streams which are directed to pass on either side of the clamping collar 20 and the truck exhaust stack 10 held within. Finally, FIG. 6 is a plan view of the present embodiment wherein the structure of the air intake orifice, jointly defined by a forward heat shield plate 100 (not visible in this figure), forward base plate 70, V-shaped air divider 60, top plate 90, and sidewalls 30*a* and 30*b*, can be readily discerned.

According to a second aspect of the present invention, there is shown in FIG. 7*a* a schematic representation of a preferred embodiment of the present invention, wherein there is provided a device for reducing the exhaust gas back pressure which is adapted for use with a slightly curved or slanted exhaust stack terminus. The design of the embodiment is identical in most respects to that described in FIGS. 1 through 6, differing principally in the means by which this embodiment is fitted to the stack. An exhaust stack with a slanted terminus 210 is gripped by a modified clamping collar 220. The clamping collar 220 contains at its upper extent a stack air shield, said air shield being modified so as to not obstruct flow of the exhaust out of the slanted pipe. Most importantly, in this embodiment a removable seal plate 200, as depicted in FIG. 7*b*, has been provided which may be extracted from said device, allowing a slightly curved stack to be placed with. Once the stack has been inserted into the device and the seal plate installed and attached, the device works exactly as is illustrated in the first embodiment supra.

According to a third aspect of the present invention, there is shown in FIG. 8 a schematic representation of another preferred embodiment of the present invention, wherein there is provided a device for reducing the exhaust gas back pressure which is adapted for use with a curved truck exhaust stack. This embodiment is designed for use with a truck exhaust stack that is curved at its terminus so substantially, even to the point where the stack terminus is essentially horizontal, that neither of the previous two embodiments can accommodate it. In the present embodiment, a curved truck exhaust stack 250 containing a hole conformable with throat 320 is illustrated. The device contains an opening which is jointly defined by interior base plate 280, left 290*a* and right 290*b* interior side walls, and interior top plate 300, said opening being designed to collect ambient air while the vehicle is in motion and said opening being most dearly illustrated in FIG. 9. The device is mounted with said opening facing the front of the vehicle. Throat 320 is formed by the extension and narrowing of the elements defining said opening. The narrowing of said opening results in an increase in the velocity of the collected ambient air as it is urged through the throat. The terminus of the throat 320 is well within the curved truck exhaust stack 250, as illustrated in FIG. 10, and the accelerated ambient air acts to assist in the expulsion of exhaust gases from the stack. The expulsion of exhaust gases is further aided by the design and configuration of top plate 270 and exterior side walls 260*a* and 260*b*. The inclination of top plate 270 accelerates a second ambient air stream upward along it, thereby creating a partial vacuum condition at the rear of the top plate 270. Exterior side walls 260*a* and 260*b* are extended above top plate 270 so as to form fins 330*a* and 330*b* which constrain said second ambient air stream to travel along the full length of the device, thereby increasing the vacuum effect behind it, reducing the amount of turbulence generated at the trailing edge of the top plate, and increasing the overall effectiveness of the device. Supporting base member 340 is cut so as to fit against the front of the stack and thereby increase the stability of the embodiment after installation. FIG. 11 contains a plan view of the underside of this present embodiment and illustrates most clearly the structure of supporting base member 340.

While the inventive device has been described and illustrated herein by reference to certain preferred embodiments in relation to the drawings attached hereto, various changes and further modifications, apart from those shown or suggested herein, may be made therein by those skilled in the art, without departing from the spirit of the inventive concept, the scope of which is to be determined by the following claims.

What is claimed is:

1. A method for reducing the exhaust gas back pressure at an upper end of a truck exhaust stack while the truck is in motion, said truck producing exhaust gases as a by-product of internal combustion, said method comprising the steps of:

(a) capturing a first ambient air stream on the face of an inclined ramp, said ramp rearwardly and upwardly inclined over the top of said upper end of said exhaust stack, and said ramp having a forward end, a rearward end, a left side and a right side, said forward end being lowered in the direction of forward travel, and the rearward end of said ramp extending above the upper end of said truck exhaust stack;

(b) directing said first air stream up the face of said ramp thereby creating a first low pressure region therebehind;

(c) capturing a second ambient air stream;

(d) dividing said second air stream into two subsidiary streams;

(e) directing one subsidiary air stream to one side of said truck exhaust stack adjacent the upper end thereof, and the other subsidiary air stream to the other side of said exhaust stack adjacent the upper end thereof, thereby creating a second low air pressure region behind said exhaust stack, whereby the exhaust gases within the stack are drawn into said low pressure region and mixed with said subsidiary air streams; and (f) releasing said exhaust gas and subsidiary air stream mixture into the atmosphere proximate to said first low pressure region.

2. A method for reducing the exhaust gas back pressure at an upper end of a truck exhaust stack while the truck is in motion, wherein said upper end of said exhaust stack is curved toward the rear of said truck and said upper end has an elbow, said elbow having an aperture cut on the forward side thereof, said method comprising the steps of:

(a) capturing a first ambient air stream on the face of an inclined ramp, said ramp rearwardly and upwardly inclined over the top of said upper end of said exhaust stack, and said ramp having a forward end, a rearward end, a left side and a right side, said forward end being lowered in the direction of forward travel, and the rearward end of said ramp extending above the upper end of said truck exhaust stack;

(b) directing said first air stream up the face of said ramp thereby creating a first low pressure region therebehind;

(c) capturing a second ambient air stream;

(d) accelerating said second ambient air stream by forcing it through a progressively narrowing passageway;

(e) conveying said accelerated ambient air stream through said aperture and into the interior of said curved truck exhaust stack;

(f) releasing said accelerated ambient air stream into said exhaust stack at a point distant from said aperture, said released air stream moving in the same general direction as said exhaust gases;

(g) mixing said released air stream with said exhaust gases; and (h) expelling said exhaust gas and air stream mixture into the atmosphere proximate to said first low pressure region.

3. A method for reducing the exhaust gas back pressure at an upper end of a truck exhaust stack while the truck is in motion, said truck producing exhaust gases as a by-product of internal combustion, said method comprising the steps of:

(a) capturing a first ambient air stream on the face of an inclined ramp, said ramp rearwardly and upwardly inclined over the top of said upper end of said exhaust stack, and said ramp having a forward end, a rearward end, a left side and a right side, said forward end being lowered in the direction of forward travel, and the rearward end of said ramp extending above the upper end of said truck exhaust stack;

(b) directing Said first air stream up the face of said ramp thereby creating a first low pressure region therebehind;

(c) constraining said first ambient air stream to remain on top of said ramp, said constraint being accomplished by placing a vertically extending fin on each side of said ramp; and (d) drawing said exhaust gas from said stack and into said first low pressure region, whereby said exhaust are released into the atmosphere.

4. A method, according to claim 3, for reducing the exhaust gas back pressure at an upper end of a vertically terminated truck exhaust stack while the truck is in motion, said method comprising the additional steps of:

(a) capturing a second ambient air stream;

(b) dividing said second air stream into two subsidiary streams;

(c) directing one subsidiary air stream to one side of said truck exhaust stack adjacent the upper end thereof, and the other subsidiary air stream to the other side of said exhaust stack adjacent the upper end thereof, thereby creating a second low air pressure region behind said exhaust stack, whereby the exhaust gases within the stack are drawn into said low pressure region and mixed with said subsidiary air streams; and (d) releasing said exhaust gas and subsidiary air stream mixture into the atmosphere proximate to said first low pressure region.

5. A method, according to claim 3, for reducing the exhaust gas back pressure at an upper end of a truck exhaust stack while the truck is in motion, wherein said upper end of said exhaust stack is curved toward the rear of said truck and said upper end has an elbow, said elbow having an aperture cut on the forward side thereof, said method comprising the additional steps of:

(a) capturing a second ambient air stream;

(b) accelerating said second ambient air stream by forcing it through a progressively narrowing passageway;

(c) conveying said accelerated ambient air stream through said aperture and into the interior of said curved truck exhaust stack;

(d) releasing said accelerated ambient air stream into said exhaust stack at a point distant from said aperture, said released air stream moving in the same general direction as said exhaust gases;

(e) mixing said released air stream with said exhaust gases; and (f) expelling said exhaust gas and air stream mixture into the atmosphere proximate to said first low pressure region.

6. A method for reducing the exhaust gas back pressure at an upper end of a vertically terminated truck exhaust stack while the truck is in motion, said method comprising the steps of:

(a) capturing an ambient air stream;

(b) dividing said air stream into two subsidiary streams;

(c) directing one subsidiary air stream to one side of said truck exhaust stack adjacent the upper end thereof, and the other subsidiary air stream to the other side of said exhaust stack adjacent the upper end thereof, wherein said subsidiary air streams are in communication with the upper end of said exhaust stack, thereby creating a low air pressure region behind said exhaust stack, whereby the exhaust gases within the stack are drawn into said low pressure region and mixed with said subsidiary air streams; and (d) releasing said exhaust gas and subsidiary air stream mixture into the atmosphere.

7. An apparatus for reducing exhaust gas back-pressure in a truck exhaust stack by partially enclosing a forward portion of the exhaust stack with an air capturing device, said apparatus mounted on said truck exhaust stack facing the front of the vehicle, comprising:

(a) a generally tubular clamping collar having an upper end and a lower end, and a forward side and a rearward side, said lower end having means for attachment to a truck exhaust stack and said upper end of said clamping collar being cut away on said rearward side;

(b) a truck stack terminus, said terminus being held within said clamping collar;

(c) a body member containing a top portion, a bottom portion, a forward portion, a rearward portion, a left side, a right side, and a body passageway connecting said forward portion and said rearward portion, wherein said body member top portion is formed in the shape of a ramp inclined upward toward the rear of the vehicle, and said bottom portion contains an aperture therethrough;

(d) means for attaching said body member to said clamping collar, said clamping collar passing through said bottom aperture of said body member and terminating within said body passageway;

(e) an air intake means within said forward body portion, said air intake means being connected to said body passageway and said air intake means obtaining an ambient air stream;

(f) an air divider means sitting within said air intake means and dividing the ambient air stream into two subsidiary air streams, said divider directing one subsidiary air stream to one side of said upper end of said clamping collar and the other subsidiary air stream to the other side of said upper end of said clamping collar; and, (e) an outlet member at the rearward portion of said body passageway.

8. An apparatus for reducing exhaust gas back-pressure in a truck exhaust stack by partially enclosing a forward portion of the exhaust stack with an air capturing device, said apparatus mounted on said truck exhaust stack facing the front of the vehicle, comprising:

(a) a generally tubular clamping collar having an upper end and a lower end, and a forward side and a rearward side, said lower end having means for attachment to a truck exhaust stack and said upper end being cut away on said rearward side;

(b) a truck stack terminus, said terminus being held within said clamping collar;

(c) a body member containing a top portion, a bottom portion, a forward portion, a rearward portion, a left side, a right side, and a body passageway connecting said forward portion and said rearward portion, wherein said body member top portion is formed in the shape of a ramp inclined upward toward he rear of the vehicle, and said bottom portion containing an aperture therethrough;

(d) air fins extending above said top portion of said body member, one air fin being on the left side of said body member and the other fin being on said right side;

(e) means for attaching said body member to said clamping collar, said clamping collar passing through said bottom aperture of said body member and terminating within said body passageway; and (f) an outlet member at the rearward portion of said body passageway.

9. An apparatus for reducing exhaust gas back-pressure in a straight truck exhaust stack according to claim 8 further comprising:

(a) an air intake means within said forward body portion, said air intake means being connected to said body passageway and said air intake means obtaining an ambient air stream; and (b) an air divider means sitting within said air intake means and dividing the ambient air stream into two subsidiary air streams, said divider directing one subsidiary air stream to one side of said upper end of said clamping collar and the other subsidiary air stream to the other side of said upper end of said clamping collar.

10. An apparatus for reducing exhaust gas back-pressure in a truck exhaust stack according to claim 8, wherein said exhaust stack is curved at its upper end to form an elbow, said elbow containing an aperture on the forward side thereof, wherein said body passageway is narrowed along its length and passes through said aperture and into said curved exhaust stack, further comprising:

(a) an air intake means within said forward portion of said body member, said air intake means connected to said body passageway;

(b) a body passageway terminus, said terminus being within said exhaust stack and at a point distant from said aperture; and (c) means for attaching said body member to said exhaust stack.

11. An apparatus for reducing exhaust gas back-pressure in a straight truck exhaust stack by partially enclosing a forward portion of the exhaust stack with an air capturing device, said apparatus mounted on said truck exhaust stack facing the front of the vehicle, comprising:

(a) a generally tubular clamping collar having an upper end and a lower end, and a forward side and a rearward side, said lower end having means for attachment to a truck exhaust stack and said upper end being cut away on said rearward side;

(b) a truck stack terminus, said terminus being held within said clamping collar;

(c) a body member containing a top portion, a bottom portion, a forward portion, a rearward portion, a left side, and a right side, and a body passageway connecting said forward portion and said rearward portion, said bottom portion containing an aperture therethrough;

(d) means for attaching said body member to said clamping collar, said clamping collar passing through said bottom aperture of said body member and terminating within said body passageway;

(e) an air intake means within said forward portion and connected to said body passageway, said air intake means obtaining an ambient air stream;

(f) an air divider means sitting within said air intake means and dividing the ambient air stream into two subsidiary air streams, said divider directing one subsidiary air stream to one side of said upper end of said clamping collar and the other subsidiary air stream to the other side of said upper end of said clamping collar; and (g) an outlet member at the rearward portion of said body passageway.

12. An apparatus for reducing exhaust gas back-pressure in a straight truck exhaust stack according to claim 11 wherein said body member has a fin extending above the surface thereof on said right side and another on said left side.

13. An apparatus for reducing exhaust gas back-pressure in a curved truck exhaust stack, said apparatus mounted on said truck exhaust stack facing the direction of forward travel and said curved exhaust stack containing an aperture on the forward side of the elbow thereof, comprising:

(a) a body member containing a top portion, a bottom portion, a forward portion, a rearward portion, a left side, and a right side, and a body passageway connecting said forward portion and said rearward portion, wherein (1) said body passageway is narrowed along its length and passes through said aperture and into said curved exhaust stack and, (2) said body member top portion is formed in the shape of a ramp extending above said curved exhaust stack and is upwardly inclined toward the rear of said truck;

(b) an air intake means within said forward body portion, said air intake means being connected to said body passageway and said air intake means obtaining an ambient air stream;

(c) a body passageway terminus, said terminus being within said exhaust stack and at a point distant from said aperture; and (d) means for attaching said body member to said exhaust stack.

14. An apparatus for reducing exhaust gas back-pressure in a curved truck exhaust stack according to claim 13, wherein said body member has a fin extending above the surface thereof on said right side and another on said left side.

* * * * *